United States Patent [19]

Wibbelsman

[11] 4,102,595

[45] Jul. 25, 1978

[54] BLEED VALVE CONTROL SYSTEM

[75] Inventor: Robert C. Wibbelsman, Cleves, Ohio

[73] Assignee: General Electric Company, Cincinnati, Ohio

[21] Appl. No.: 733,876

[22] Filed: Oct. 19, 1976

[51] Int. Cl.[2] ..... F01D 17/06

[52] U.S. Cl. ..... 415/1; 415/28; 415/29; 60/226 R

[58] Field of Search ..... 415/1, 28, 39; 60/39.29, 226 R

[56] References Cited

U.S. PATENT DOCUMENTS

| | | | |
|---|---|---|---|
| 2,785,848 | 3/1957 | Lombard et al. | 60/39.29 |
| 2,837,269 | 6/1958 | Torell | 60/39.29 |
| 2,873,576 | 2/1959 | Lombard | 60/39.29 |
| 2,978,166 | 4/1961 | Hahn | 415/28 |
| 3,091,080 | 5/1963 | Crim et al. | 60/39.29 |
| 3,638,428 | 2/1972 | Shipley et al. | 60/39.29 |
| 3,688,504 | 9/1972 | Hutchinson et al. | 415/28 |
| 3,996,964 | 12/1976 | McCombs | 415/28 |

*Primary Examiner*—C. J. Husar

*Attorney, Agent, or Firm*—Dana F. Bigelow; Derek P. Lawrence

[57] ABSTRACT

The opening of variable bleed doors is scheduled as a function of both booster and compressor speed so as to better maintain the desired booster stall margin and increase efficiency during certain periods of engine operation. The schedule based on core speed is modified in response to changes in fan speed to increase or decrease the amount of bleed, thereby increasing stall margin or improving the steady-state performance, respectively.

14 Claims, 5 Drawing Figures

BLEED VALVE CONTROL SYSTEM

BACKGROUND OF THE INVENTION

This invention relates generally to a turbofan engine control system and, more particularly, to a method and apparatus for scheduling the opening of variable bleed doors to maintain a proper interflow between a booster stage and a downstream compressor.

It is common in the manufacture of turbofan engines to increase the overall engine compression ratio by adding one or more booster stages upstream of the compressor. These booster stages are normally driven independently from the compressor and are disposed within the core engine compressor flow passage. Accordingly, in order to maintain the proper relationship between the amount of air being discharged from the booster and that being pumped through the compressor over variable modes of operation, it has been found advantageous to provide a bypass valve mechanism such as that shown in U.S. Pat. No. 3,638,428, issued to Gerald E. Shipley, et al on Feb. 1, 1972 and assigned to the assignee of the present invention, for bypassing a portion of the air pressurized by such booster stages during off-design engine operation so as to prevent aerodynamic stall caused by the back pressuring of the booster stages because of the inability of the core compressor to accept all of the air supplied.

A common approach is to schedule the opening of the variable area bypass doors as a function of core speed only, and for optimization either at a particular engine operating point or over a relatively narrow band of engine operation, such as, for example, a particular flight Mach number at high altitude cruise. However, since there is a different core-booster rotor speed-match for different flight Mach numbers, then, at operating points which are higher or lower than that of the design, there may be either a loss of performance by the bleeding off of too much air or the loss of stall margin by the failure to bleed off enough air.

The mismatch between booster and core is made more complicated by the difference in the moment of inertia of the two rotor systems. The core rotor with the smaller moment of inertia will accelerate and decelerate faster than the booster or fan rotor, so that during periods of acceleration, the bleed doors may be completely closed, but during periods of deceleration, the bleed door opening requirements for meeting the desired stall margin may very well be greater than that corresponding to the designed engine operating point. If the resultant loss in booster stall margin is caused by the back pressuring on the booster, then aerodynamic stall of the booster stages could result.

A further condition which may tend to intensify the problem of core-booster mismatch, is that of variation in the condition of the core. It is recognized that the quality of a core varies due to production tolerances or engine in-service deterioration, and a system which schedules the opening of the bleed doors solely as a function of core speed will tend to have this mismatch intensified by a degradation of the core quality.

It is therefore an object of this invention to provide a bypass modulating system which allows for the maintenance of a desired booster stall margin regardless of the flight or power level condition.

Another object of this invention is the provision in a bleed control system for maintaining a desired booster stall margin during periods of engine deceleration.

Yet another object of this invention is the provision for a booster bleed control system which does not degrade the booster stall margin as a result of new engine manufacturing variations or in-service quality deterioration.

Still another object of this invention is the provision for a booster bleed modulation system which automatically compensates for engine rpm transients so as to prevent a loss in stall margin.

A further object of this invention is to provide a bleed door control system which is simple in construction and effective in use.

These objects and other features and advantages become more readily apparent upon reference to the following description when taken in conjunction with the appended drawings.

Briefly, in accordance with one aspect of the present invention, both the speed of the core and that of the booster are sensed and the opening of the bleed doors is modulated in response thereto over all ranges of engine operation. In this way, the difference between the core speed, which is indicative of corrected core flow, and the booster speed, which is indicative of booster corrected flow, provides an indication of the amount of air that is to be bled off.

In accordance with another aspect of the invention, the steady-state bleed schedule, which schedules the opening of the bleed door solely as a function of the core speed is modified in response to the speed of the booster. The schedule may be accordingly increased or decreased so as to increase the booster stall margin or to increase the engine performance, respectively.

By yet another aspect of this invention a fan speed reference is generated by comparing the actual core speed with a steady-state reference schedule, and then an actual fan speed is compared with the referenced fan speed to obtain a biasing factor which in turn is applied to the basic steady-state bleed door schedule so as to increase or decrease the amount of air that is bled off.

The present invention provides for the maintenance of a desired booster stall margin regardless of the power level operating condition, and allows trade-offs between the stall margin and steady-state performance at any or all power level conditions. Since it takes into consideration both the amount of air which the core is accepting and the amount of air which the booster is delivering, engine rpm transients are automatically compensated for so as to prevent a resulting loss in stall margin. Further, the booster stall margin is made insensitive to new engine manufacturing variations and to in-service quality deterioration.

In the drawings as hereinafter described, the preferred embodiment is depicted; however, various other modifications and alternate constructions can be made thereto without departing from the true spirit and scope of the invention.

DESCRIPTION OF THE PREFERRED EMBODIMENT

Figure 1:
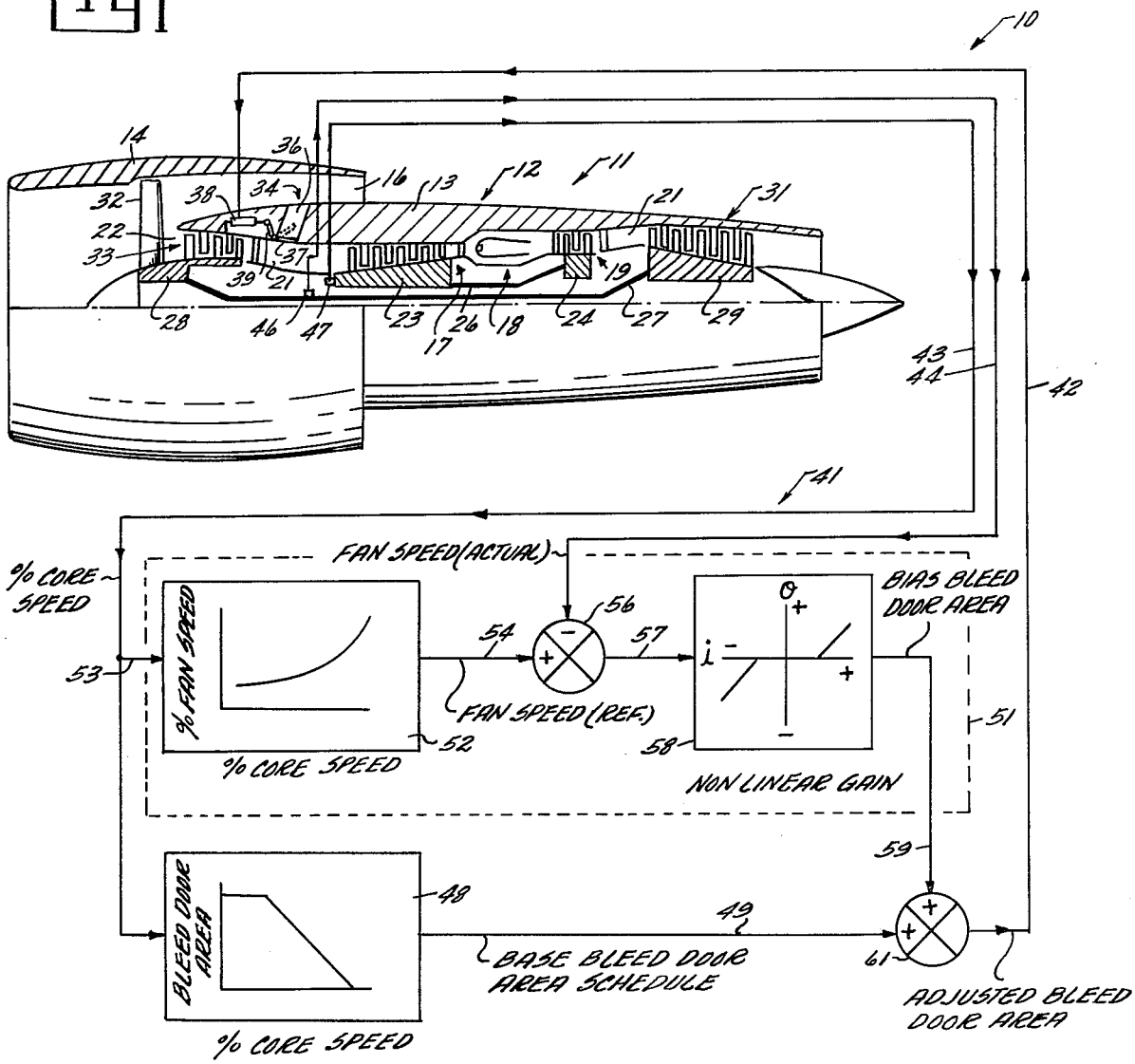
FIG. 1 is a cross-sectional view of a turbofan engine employing an exemplary embodiment of the control system of the present invention as shown in block diagram form.

Referring now to FIG. 1, the invention is shown generally at 10 as incorporated into the control structure of a turbofan engine 11 which comprises a core engine 12 having a supporting structure or casing 13 which projects into the downstream end of an annular fan casing 14 so as to cooperatively define an exhaust duct 16 therebetween. The core engine 12 comprises a compressor 17, a combustor 18 and a turbine 19 disposed in serial flow relationship along an annular core engine passageway 21 having an inlet 22. The compressor 17 and the turbine 19 include, respectively, rotor portions 23 and 24 which are interconnected and define a core engine rotor 26.

A low pressure rotor 27 is suitably supported by the casing 13 for rotation independently of the core engine rotor 26 and includes a fan rotor 28 in the rotor portion 29 of a low pressure turbine 31. The fan rotor includes a plurality of fan blades 32 which extend generally radially therefrom, upstream of the core engine passage inlet 22, and a plurality of booster stages 33 which extend across the core engine passage 21 for pressurizing the air prior to delivery to the compressor 17.

Disposed between the booster stages 33 and the compressor 17 is a bleed means 34 for bleeding the air from the booster. It comprises a plurality of bleed passageways 36 and means for varying the bleed flow area thereof, including a valve member 37 for closing and variably opening such passageway 36 and suitable actuator means 38 for positioning the valve members through suitable linkage means 39.

Modulation of the bleed means 34 is accomplished by way of a control system 41 which transmits signals to the actuator means 38 along line 42. Inputs to the control system 41 include a fan speed signal transmitted along line 44 and a core speed signal transmitted along line 43. These signals are derived, respectively, from the fan speed sensor 46 connected to the low pressure rotor 27 and a core speed sensor 47 connected to the core engine rotor 26. The sensors may be of the mechanical, electrical, or electromechanical type; however, for purposes of description, the present sensors 46 and 47 will be considered to be of the electrical type wherein electrical signals are generated and transmitted along lines 43 and 44 to a control system 41 for modulation of the bleed means 34.

It will be recognized that the lower part of the block diagram of FIG. 1 represents a conventional type of control system wherein the core speed signal is transmitted along line 43 to a function generator 48 whose output line 49 transmits a signal to line 42 so as to schedule the desired bleed area or bleed valve position as a function of the core speed in accordance with a predetermined schedule. The temperature of the air may also be sensed so as to adjust to a core corrected speed so as to thereby provide a more accurate input signal to the function generator 48. Such a conventional system presumes that the booster-compressor speed match which is established for a particular operating line, will also be applicable and accurate for other operating lines. In other words, it presumes that since the compressor speed, and therefore the amount of air which the compressor is capable of bypassing, is known, then the booster speed and the amount of air which the booster is providing, is known. Then the difference may be bled in accordance with a predetermined schedule. However, a brief analysis of the performance characteristics over variable operating conditions will show that these presumptions will introduce significant error into the control system.

Figure 2:
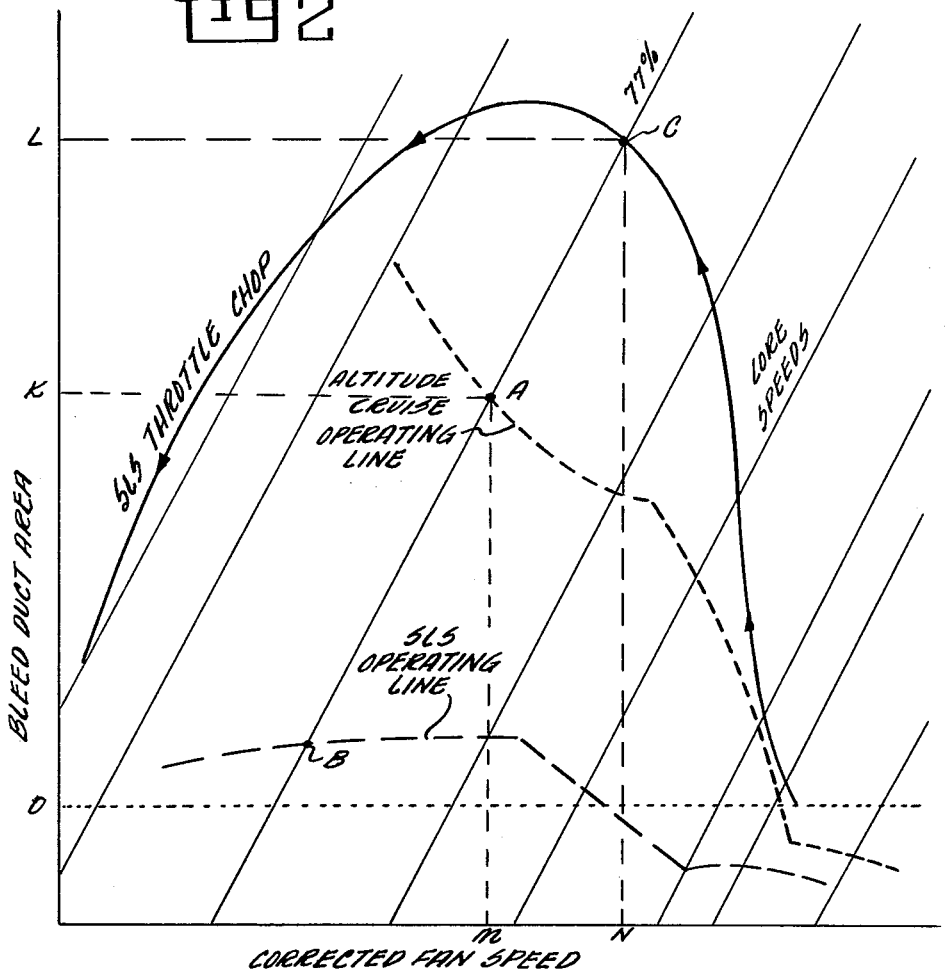
FIG. 2 is a graphic illustration of a typical bleed schedule in accordance with the various operating lines.

Referring now to FIG. 2, a typical operating schedule with the sea level static (SLS), altitude cruise operating line, and sea level throttle chop conditions represented. As stated hereinbefore, dual rotor compressors are customarily matched for operation at one engine operating point such as, for example, high altitude cruise. Therefore, the amount of air which is bled off will be controlled in accordance with that operating line, irrespective of the actual operating point of the engine. To illustrate, let it be assumed that the core speed is at 77 percent which, assuming that the engine was designed for matched operation at high altitude cruise condition, will cause a bleed off of air in an amount K corresponding to point A on the graph. However, it will be recognized that if the engine is operating at speeds other than those represented by the high altitude cruise operating line, then there may be either too much air being bled off or not enough air. For example, if the engine is actually operating on the SLS operating line, the amount of bleed air required (that amount corresponding to point B), is much less and, to the extent that more air is bled off, performance penalties will result. Conversely, if the engine is operating under conditions of an SLS throttle chop, the desired amount of air to be bled off L, corresponds to point C on the graph. If only the lesser amount K, corresponding to point A, is bled off, then the backpressure from the compressor will raise the booster operating line and therefore decrease the stall margin to a point below that required for safe operation.

Figure 3:
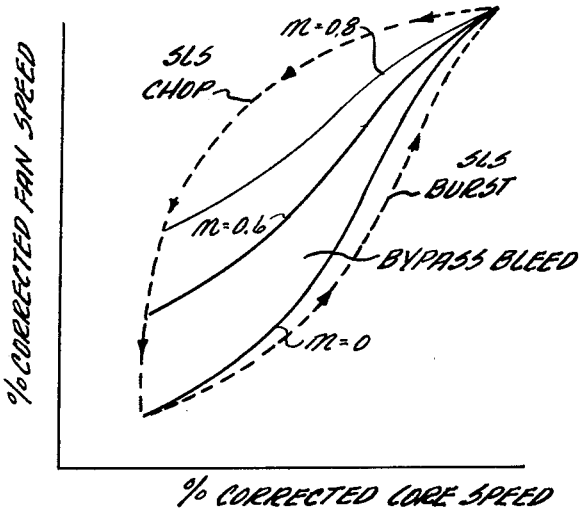
FIGS. 3 and 4 are graphic illustrations of the core-booster speed and airflow matches as they vary with the flight Mach numbers.
Figure 4:
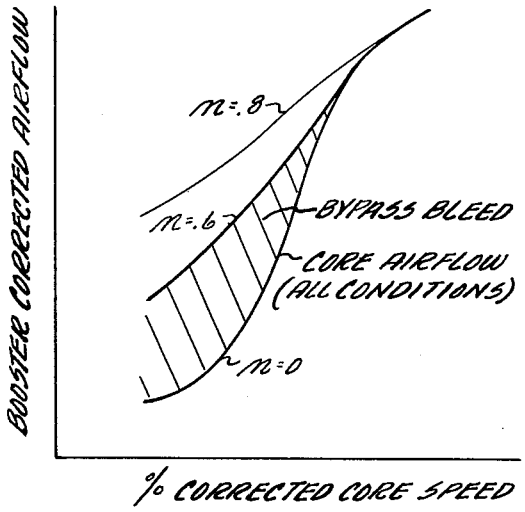

For further illustration, refer to FIGS. 3 and 4 and assume that the engine has been designed for matched booster-compressor operation at an operating point of $M = 0.6$. As can be seen, the booster corrected speed increases relative to core corrected speed with increasing aircraft Mach number. Correspondingly, since corrected rotor rpm is indicative of corrected airflow, the booster discharge airflow also increases relative to the corrected core airflow when the flight Mach number increases. Accordingly, the amount of air that must be bled off is represented by the hatched portion of FIG. 4. Now if the engine is actually running at an operating point of $M = 0.8$ rather than at the matched point of $M = 0.6$, then the amount of air which is bled off may be deficient so as to result in a loss of stall margin.

In addition to the ram pressure effect as just described, inertia differences between the booster and the compressor also cause booster-compressor mismatches during transient conditions of operation. This can be seen in FIG. 3. During a rotor burst or high acceleration, the low inertia compressor tends to accelerate faster than the booster so as to provide a capability of receiving more air than the booster delivers, even with the bleed booster doors completely closed. However, during periods of deceleration, the higher inertia booster continues to pump air faster than the compressor can receive it, and therefore a greater amount of air must be bled off. Otherwise, the booster operating line may increase to a point which results in an unsafe condition.

The present invention is intended to alleviate the problems discussed hereinabove by introducing another parameter to the control system. The actual fan speed, or if desired a modified signal indicative of booster corrected airflow, is introduced to a biasing circuit 51 (indicated by the dotted block in FIG. 1) to modify the output of the conventional function generator 48.

The biasing circuit 51 includes a reference schedule 52 which computes the reference fan speed for the core speed at the design point of the control. The actual core speed is fed from line 43 along input line 53 to the reference schedule 52, and a representative fan reference speed signal is generated at the output line 54. The fan reference speed signal is then compared with the fan actual speed signal by way of a summer 56 and the resultant signal (either positive or negative) is transmitted along line 57 to a nonlinear amplifier 58. The resulting bias signal is transmitted along 59 to a summer 61 where it is applied to the output of the function generator 48 to arrive at an adjusted bleed door signal to be transmitted along line 42.

In operation, the actual fan speed is sensed and compared with the fan reference speed signal. If, as may be the case in the execution of a throttle chop, the actual fan speed exceeds the reference speed, then the basic bleed schedule is biased openly and the bleed will be opened an additional amount which is proportional to the actual booster speed.

Figure 5:
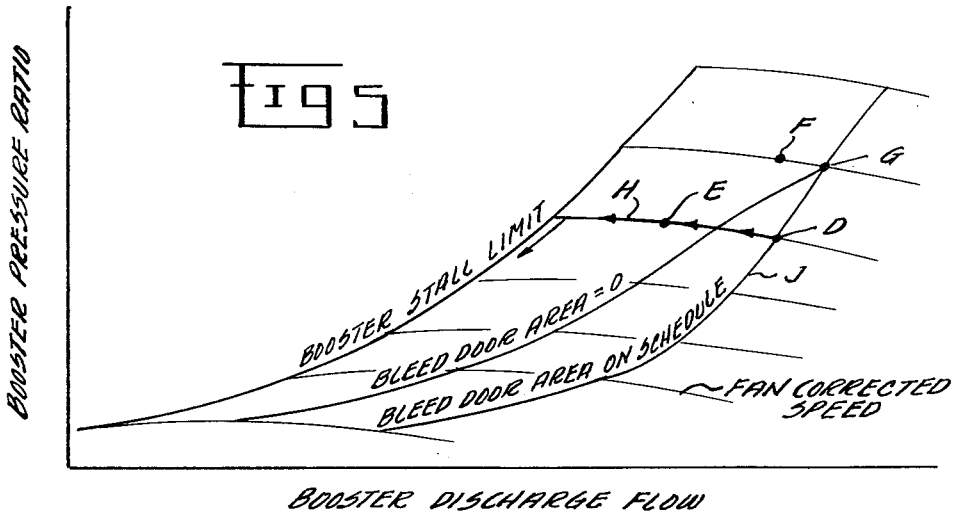
FIG. 5 shows a booster compressor map as it is affected by application of the present invention under various points of operation.

Referring now to FIG. 5, the effect of the present control system is shown on a booster compressor map as the relative speeds of the booster and core are varied. Initially, the engine is running at a steady-state condition represented by a given booster corrected speed and given core corrected speed, with the booster operating at point D, well within the limits of an acceptable stall margin. If the core speed is now reduced while maintaining a constant booster speed, and the booster bleed doors are held in a fixed position, the operation of the booster will move to point E and a portion of the stall margin will be lost. However, with the operation of the present invention, the bleed doors will be opened to accommodate the flow difference between points D and E and the booster operation point will again move back to point E where it regains its lost stall margin. If, on the other hand, booster speed is increased and the core speed is maintained constant, operation of the booster will move to point F and stall margin will again be lost. If the bleed doors are further opened as a result of the operation of the present invention, then the proper amount of air will be bled off, as represented by the flow difference between points F and G, and the booster will regain its lost stall margin.

Considering now a throttle chop deceleration, wherein the booster declerates very slowly relative to the core, the booster performance will be represented by line H. In this case, a relatively high bleed rate will have to be maintained in order to bring back the booster to the desired operating line as represented by line J. Since booster discharge corrected airflow and core corrected airflow are proportional to booster corrected speed and core corrected speed, respectively, the desired booster operating line J can always be maintained if the doors are scheduled as a function of core corrected speed and fan corrected speed.

Referring again to FIG. 2, it will be seen that the addition of the corrected fan speed parameter simplifies and improves the scheduling of the bleed door opening by automatically incorporating the variable factors which otherwise tend to cause a deviation from the desired bleed schedule. The bias which is introduced by the present invention allows the operation of the bleed doors to move away from the schedule which is represented by the dotted line (operating line) in FIG. 2. For example, whereas the conventional system is unable to determine between the operating conditions of points A and C, the present system automatically introduces bleed (as represented by the difference between points K and L) as a result of the system's ability to distinguish corrected fan speed M and N and to introduce the representative signals so as to modify the conventional steady-state bleed schedule.

From the foregoing, it will be appreciated that the present invention provides simplified, reliable and accurate means for varying the modulation of the bypass airflow so as to maintain a desired booster stall margin during all levels of engine operation. It automatically compensates for errors that would otherwise be introduced by the ram pressure effect, the inertia differences between booster and core during transient operation, and for new engine manufacturing variations and in-service quality deterioration.

While an exemplary embodiment has been schematically depicted and described, it will be appreciated by those skilled in the art that the present invention may be represented and practiced by various other forms and embodiments.

Having thus described the invention, what is considered novel and desired to be secured by Letters Patent of the United States is:

1. An improved turbomachine bleed control system of the type having in serial flow relationship a first compressor, a bleed system, and a second compressor, the bleed system being capable of bleeding off discharge air from the first compressor in response to a bleed schedule which varies as a function of airflow in the second compressor wherein the improvement comprises:

a. means for sensing the first compressor speed and generating a biasing signal as a function thereof; and b. means for generating a modified bleed schedule by applying said biasing signal to the bleed schedule.

2. An improved turbomachine bleed control system as set forth in claim 1 wherein said first compressor includes at least one booster stage disposed in the airflow path of the second compressor and driven independently of said second compressor.

3. An improved turbomachine bleed control system as set forth in claim 1 wherein said sensing means comprises means for generating an electrical signal representative of the speed of said first compressor.

4. An improved turbomachine bleed control system as set forth in claim 1 wherein said generating means applies said biasing signal to the bleed schedule by summing the two signals.

5. An improved turbomachine bleed control system as set forth in claim 1 wherein said generating means operates in response to both the sensed speed of the second compressor and that of the first compressor.

6. An improved turbomachine bleed control system as set forth in claim 5 wherein said generating means further includes a steady-state function generator which receives a signal representative of the actual core speed and generates a representative steady-state fan speed reference signal.

7. An improved turbomachine bleed control system as set forth in claim 6 wherein said generating means further includes means for comparing said first compressor speed with said fan speed reference signal to obtain a resultant output signal.

8. An improved turbomachine bleed control system as set forth in claim 7 wherein said generating means further includes an amplifier which receives said output signal and generates a bias signal for modifying the schedule.

9. An improved turbomachine bleed control system of the type having in serial flow relationship a first compressor, a bleed system, and a second compressor, the bleed system being capable of bleeding off discharge air from the first compressor in response to a bleed schedule which varies as a function of airflow in the second compressor, wherein the improvement comprises:

a. means for sensing first compressor speeds;
b. means for generating a reference schedule as a function of the speed of the second compressor;
c. means for comparing said first compressor speed with said reference schedule to obtain a bias signal; and
d. means for applying said bias signal to modify the bleed schedule.

10. An improved turbomachine bleed control system as set forth in claim 9 wherein said sensing means comprises means for generating an electrical signal representative of said first compressor speed.

11. An improved turbomachine bleed control system as set forth in claim 9 wherein said reference generating means has incorporated therein a steady-state bleed schedule.

12. An improved turbomachine bleed control system as set forth in claim 9 wherein said bias application means is capable of making both positive and negative modifications to the scheduled amount of air to be bled off.

13. An improved turbomachine bleed control system as set forth in claim 9 wherein said means for applying said bias signal to modify the bleed schedule comprises a summing device.

14. An improved method of controlling a turbomachine bleed system of the type having in serial flow relationship a first compressor, a bleed system and a second compressor, the bleed system being capable of bleeding off discharge air from the first compressor in response to a bleed schedule which varies as a function of airflow in the second compressor, wherein the improvement comprises the steps of:

a. sensing the first compressor speed and operating a biasing signal as a function thereof; and
b. generating a modified bleed schedule by applying said biasing signal to the bleed schedule.

* * * * *